US005524366A

United States Patent [19]

Caeran

[11] Patent Number: 5,524,366

[45] Date of Patent: Jun. 11, 1996

[54] SKI SHOE

[75] Inventor: Francesco Caeran, Montebelluna-Treviso, Italy

[73] Assignee: HTM Sport- und Freizeitgeraete Aktiengesellschaft, Schwechat, Austria

[21] Appl. No.: 382,234

[22] Filed: Jan. 31, 1995

[30] Foreign Application Priority Data

Feb. 1, 1994 [AU] Australia ..... 184/94

[51] Int. Cl.[6] ..... A43B 5/04

[52] U.S. Cl. ..... 36/117; 36/120; 36/121

[58] Field of Search ..... 36/117, 118, 119, 36/120, 121

[56] References Cited

U.S. PATENT DOCUMENTS

| | | | |
|---|---|---|---|
| 3,848,347 | 11/1974 | Hanson et al. | 36/2.5 |
| 3,936,959 | 2/1976 | Hanson et al. | 36/2.5 |
| 4,073,073 | 2/1978 | Seidel | 36/121 |
| 4,754,560 | 7/1988 | Nerrinck | 36/119 |
| 4,962,594 | 10/1990 | Marega et al. | 36/117 |

*Primary Examiner*—Paul T. Sewell
*Assistant Examiner*—Marie Denise Patterson
*Attorney, Agent, or Firm*—Flynn, Thiel, Boutell & Tanis

[57] ABSTRACT

A ski shoe comprising a shell (1) and a movably hinged shaft 2 of the shoe wherein the shell is formed of an elastic material and has a raised shell part (3) around which the shaft 2 of the shoe extends. The raised shell part (3) carries above the heel a vertical slot (4), which is upwardly open. The shaft 2 of the shoe presses when in a forward position onto the raised shell part (3) so that the slot (4) closes. A spacer (7) is movable in the slot (4) by an adjusting device and depending on its position acts against the closing movement of the slot (4) and thus the forward movement of the shaft 2 of the shoe. For adjustment in a slotted hole, the spacer (7) is supported on one arm (9) of a two-arm bent lever (10) and the other arm (13) of which carries a nut (14), which moves on an axially nonmovable spindle (15). The spindle (15) can be rotated, for example, with a key, which causes the bent lever (10) to carry out a pivoting movement and the spacer (7) to move in the slot (4). The adjusting device is arranged in the gap between the shaft 2 of the shoe and the shell (1) and is connected fixedly, for example, to the shaft 2 of the shoe (as seen in FIG. 3).

6 Claims, 3 Drawing Sheets

SKI SHOE

FIELD OF THE INVENTION

The invention relates to a ski shoe comprising a shell and a shaft of the shoe, which, for example, is movable relative to the shell into a forward position and into which projects at least a raised shell part on the side of the heel, wherein the raised shell part forms an inner wall parallel to the shaft of the shoe. The wall has a slot open in an upward direction wherein the longitudinal edges of the slot define the width of the slot and are spaced from one another at a distance. The distance is reduced against the elasticity of the material when the shaft of the shoe, which shaft extends over the slot of the shell, is in the forward position, or rather the distance opens by a spacer during straightening of the shaft of the shoe. The spacer acts against the narrowing of the width of the slot and is arranged movably in the slot by an adjusting device.

BACKGROUND OF THE INVENTION

A modern ski shoe supports the forward position of the skier during downhill skiing by permitting the shaft of the shoe to assume an inclined position in a skiing direction relative to the shell and thus relative to the base member of the ski shoe. Designs are known, in which this forward movement to the inclined position occurs against an adjustable resistance. The raised shell part, which is surrounded by the shaft of the shoe and which itself elastically surrounds the leg of the user like a sleeve, has for this purpose an upwardly open U-shaped slot above the heel. The shaft of the shoe lies in its erect position approximately concentric with respect to the raised shell part. When the skier moves into the forward position, the shaft of the shoe assumes an inclined position relative to the shell and also relative to the raised shell part, which inclined position results in the shaft of the shoe resting with its inner surface on the outer surface of the raised shell part and applying a pressure onto the outer surface. The elastic raised shell part yields, especially since the form stability is weakened by the vertical slot. With an increasing inclined position of the shaft of the shoe, the shaft of the shoe compresses the slot due to its roundness, which has a width of, for example, 1 cm, until the longitudinal edges defining the slot contact one another near the upper edge of the shell. Thus the slot opens elastically during relief and closes under the pressure of the forwardly inclined shaft of the shoe. Aside from the material of the shell, the length and the geometry of the slot are a measure for the resistance, which is applied against the forward movement of the shaft of the shoe by the shell.

From U.S. Pat. No. 3,848,347 and U.S. Pat. No. 3,936,959 it is known to close a slot on a ski shoe by a movable clamp, which slot allows freedom of movement in one direction. Depending on the position of the clamp the slot is more or less effective.

EP-A2 350 023 discloses a ski shoe with a vertical slot in the heel area of the shell, in which a carriage is longitudinally movably arranged in the slot as a spacer, which can be moved on a spindle. The carriage rests on both sides on the walls of the slot and prevents or makes difficult the narrowing of the width of the gap of the slot depending on its elevational position in the slot. The spindle extends over and parallel to the entire length of the slot, and can be rotated by a knurling tool for effecting an elevational adjustment of the carriage in the slot. The higher the carriage is adjusted in the slot, the greater is the resistance against the forward movement of the shaft of the shoe. A similar design is furthermore known, in which the slot in the shell has a downwardly diverging edging and in which the spacer or rather a spreader is elevationally adjustable on a vertical spindle. These long threaded spindles in the heel area of the ski shoe stiffen the shaft of the shoe in an undesired manner and are highly stressed. When they bend, the result is that the elevational adjustment no longer functions and the spacer or rather the spreader jams up. Moreover, adjustment by means of an adjusting device in the heel area is unfavorable and is difficult to reach with the hands when the ski is attached.

SUMMARY OF THE INVENTION

The invention has the goal of improving a ski shoe having an adjustable resistance acting against the forward movement of the shaft of the shoe with respect to the adjusting device, and of moving the adjusting device out of the direct heel area and designing same in such a manner that it itself does not influence the characteristics of the ski shoe or else is protected against damage.

This goal is attained in a ski shoe of the above-described type, in which according to the invention the spacer is movably supported on one arm of a pivotal bent lever in a longitudinal slot of the arm and the other arm of the bent lever carries a threaded nut, which nut is arranged adjustably on an axially nonmovably supported, rotatable spindle. The arm permits the lateral mounting of the adjusting device next to the slot. A translation of the adjusting movement is achieved with the bent lever. The spindle can be operated from the side, and thus for the right shoe from the right and for the left shoe from the left.

When the spindle and the bent lever are supported such that the spindle is supported on a mounting and is fastened on the shell or on the shaft of the shoe and laterally next to the slot preferably at half of the height of the slot and a fulcrum of the bent lever also is supported by the mounting, then a specially compact, flat embodiment is achieved, which fits into the space between the shell and the shaft of the shoe. The arrangement of the structural parts is further advantageous wherein the spindle is arranged at a right angle relative to the slot or the raised shell part and has a small hand wheel or a screwhead preferably formed as a hexagonal recess at an end thereof opposite the slot, because this arrangement results in good accessibility to the spindle, for example, with a tool.

When the spacer is designed with a flat disc cantilevered from the arm and extending through the slot with a diameter proximate the width of the slot, it is then adjustable with little friction in the slot. Also, the spacer movably guided in the slot can be designed mushroomlike by extending a small plate over the slot to prevent it from being pressed out of same. In order to be able to control and reproduce the adjustment, an indicator or mark is provided on the threaded nut opposite the area of the viewing opening in the shaft of the shoe for indicating the position of the threaded nut along the spindle. The design of the bent lever is advantageous wherein the bent lever is formed of a spring steel which adapts to the curvature of the shell in a space between the shaft and the shell or the raised shell part, because during changes in the position of the shaft of the shoe relative to the cup the bent lever can adapt to the shift. The spacer is supported in a slotted hole on the bent lever. This contributes to the adjustment being maintained even during a reciprocal movement of the shell and shaft of the shoe. With such an invention, the aforesaid goal is achieved.

BRIEF DESCRIPTION OF THE DRAWINGS

Preferred embodiments of the subject matter of the invention are illustrated in the drawings, in which.

DETAILED DESCRIPTION

Figure 1:
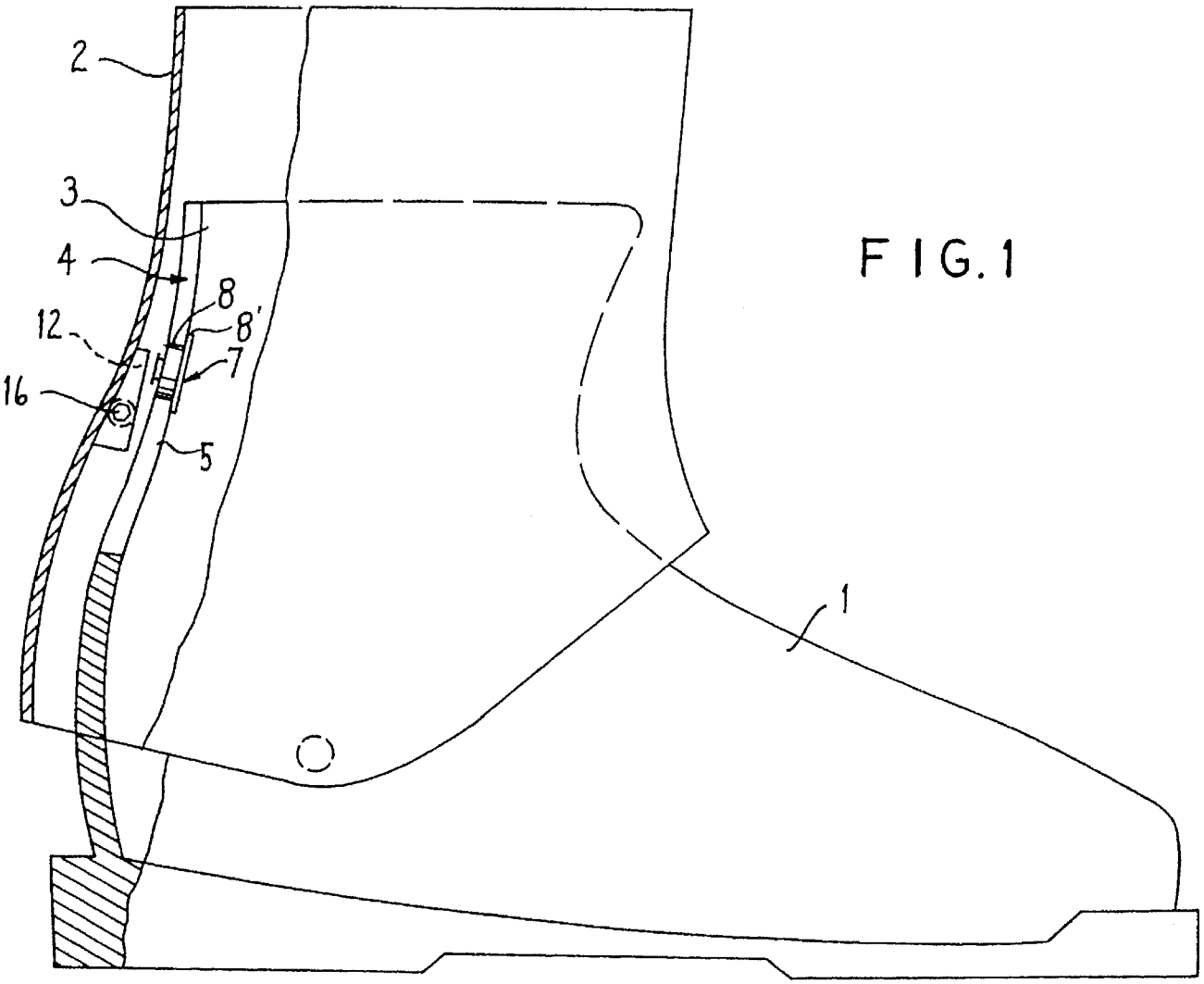
FIG. 1 shows a side view in partial section of a ski shoe made out of a shell and a shaft of a shoe in an erect position.
Figure 1A:
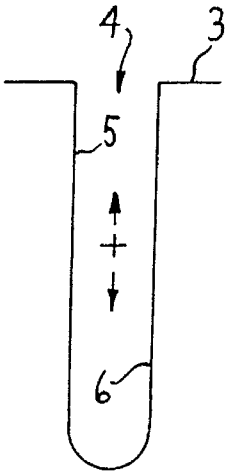
FIG. 1*a* shows the slot in the shell on the side of the heel.
Figure 2:
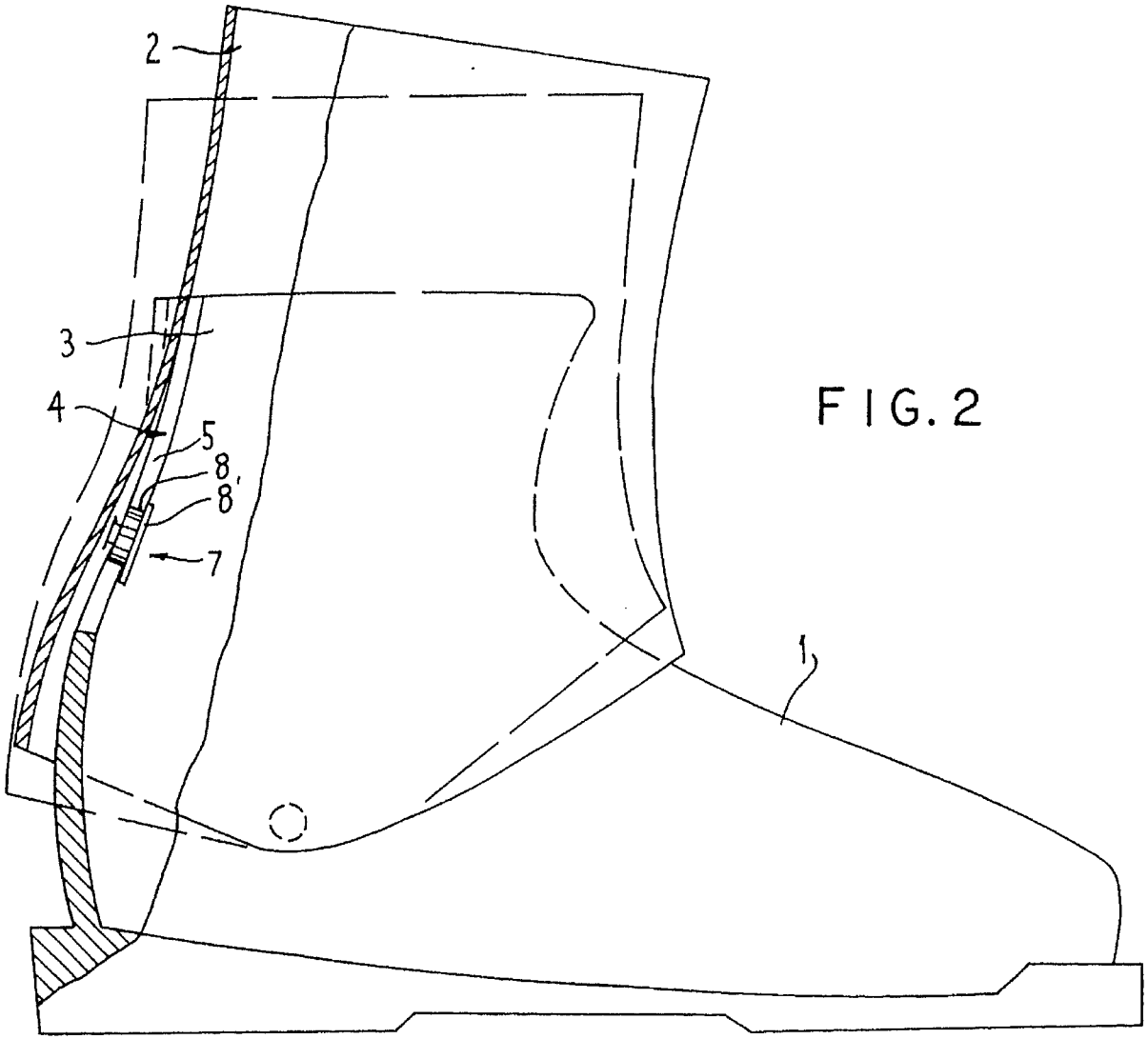
FIG. 2 shows a side view in partial section of the shaft of the ski shoe according to FIG. 1 in the forward position.
Figure 2A:
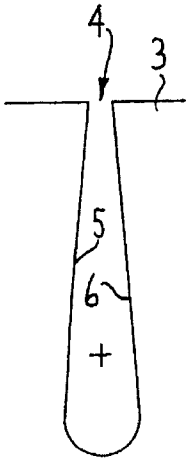
FIG. 2*a* shows the slot in the shell according to FIG. 2 when the shaft of the shoe is in the forward position.

Referring to FIG. 1, a ski shoe includes a shell 1 formed of an elastic plastic and a shaft 2 of the shoe which is rotatably hinged to said shell. The shaft also can be constructed of multiple parts as a front and rear shaft of the shoe. A slot 4 exists in the raised shell part 3, which is enclosed by the shaft 2 of the shoe. The slot 4 is illustrated in FIG. 1*a*. When the shaft 2 of the shoe is in an erect position, namely where the skier stands up straight, then the shaft 2 of the shoe and the shell 1 assume with respect to one another the position illustrated in FIG. 1. The skier may also assume a forward position in the downhill skiing position, which results in the relative position of the shaft 2 of the shoe illustrated in solid lines in FIG. 2. In particular, the shaft 2 of the shoe presses onto the raised shell part 3 causing the shell part 3 to be deformed within the limits of its elasticity. The slot 4 is compressed (as seen in FIG. 2*a*) until finally the longitudinal edges 5, 6 defining the slot 4 contact one another in the upper area thereof. With a spacer 7, the elevation of which is adjustably arranged in the slot 4, it is possible to adjust the resistance against the forward movement of the shaft 2 of the shoe.

Figure 5:
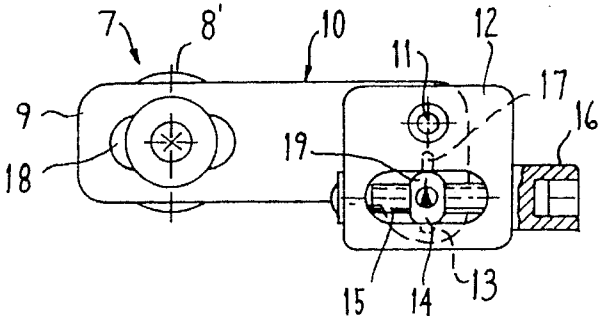
FIG. 5 shows an embodiment of the adjusting device in a rear view.
Figure 6:
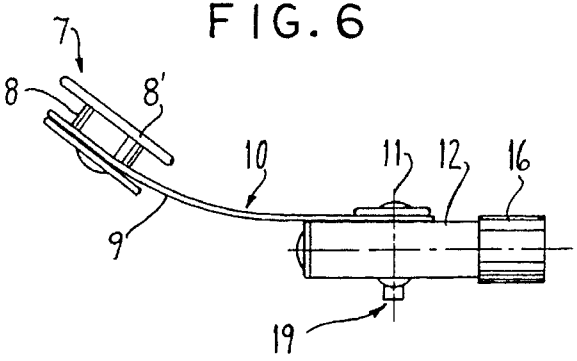
FIG. 6 shows the adjusting device as viewed from above.
Figure 3:
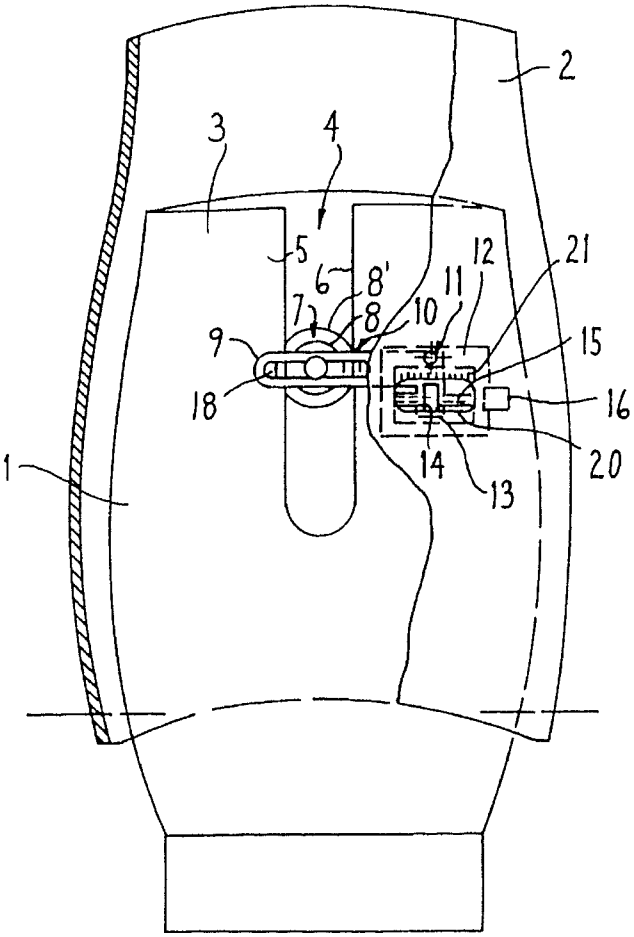
FIG. 3 shows a partially cut-open rear view of a ski shoe according to FIG. 1 provided with an adjusting device.

The spacer 7 is designed as a circular-cylindrical, flat disk 8, in front of which is a small plate 8' which extends laterally beyond the width of the slot 4 and thus prevents the spacer 7 from falling out. The height of the cylindrical disk 8 corresponds to at least the wall thickness of the raised shell part 3 in the slot area and the diameter corresponds approximately to the width of the slot 4. One arm 9 of a two-arm bent lever 10 is attached to the outer end of the spacer 7. The arm 9 is part of an adjusting device (FIGS. 3 and 5, 6) for adjusting the position of the spacer 7 in the slot 4 and can be pivoted about a fulcrum 11 in a mounting 12. A threaded nut 14 is rotatably connected to the other arm 13 of the bent lever 10, which nut moves on a rotatable threaded spindle 15. The threaded spindle 15 is supported nonmovably and axially in the mounting 12. A screwhead 16 with a depression is used for receiving a screwdriver and thus for adjusting the nut 14 along the spindle 15. It is also possible to provide a knurled adjusting wheel on the spindle 15 for direct manual operation.

The mounting 12 is inserted so as to be stationary in a pocket of the shaft 2 of the shoe between the shaft 2 of the shoe and the shell 1. However, the mounting 12 can also be fixedly connected to the shell 1. When the spindle 15 is rotated with a screwdriver through an opening in the shaft 2 of the shoe, then the bent lever 10 pivots about the fulcrum 11. For kinematic reasons, the nut 14 and also the spacer 7 are each guided in respective slotted holes 17, 18 on the arms 9 or 13. The spacer 7 slides upwardly or downwardly in the slot 4.

Figure 4:
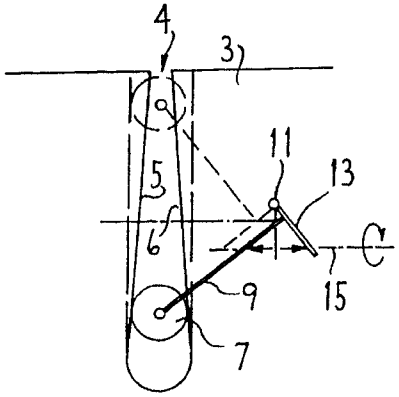
FIG. 4 shows the adjusting range of the adjusting device with respect to the slot.

FIG. 4 shows the principle of the adjustment of the spacer 7 in the slot 4 wherein the solid lines show the lower end position of the spacer 7 and the dashed lines show the upper end position of the spacer 7 in the slot 4. When the spacer 7 is in the position shown in solid lines, then the slot 4 is fully effective and can be compressed during the forward movement of the shaft 2 of the shoe against a slight resistance by the shell 1 or rather the raised shell part 3. The shell 1 or rather the raised shell part 3 puts forth the maximum resistance against the forward movement of the shaft of the shoe by the spacer 7 being disposed in the upper end position in the slot. The skier chooses between the end positions of the spacer 7 which best meets his/her wishes for defining the forward position or rather, for defining a forward resistance.

The nut 14 carries a mark 19 or a nose as the indicator therefor. A viewing window 20 is oriented in the longitudinal direction of the spindle 15 and provided in the shaft 2 of the shoe opposite the nut 14, which window shows the mark 19. A scale 21, for example, with position numerals is provided on the edge of the viewing window 20 so that the mark 19 can be adjusted individually to a specific numeral. Empirical values for special downhill skiing situations or skiing techniques can be collected and again adjusted.

The arm 9 of the bent lever 10 is manufactured of a flexible material, for example, of a spring steel so that it can adapt to the curvature of the shaft 2 of the shoe or of the shell 1 in the raised shell part 3. The arm 9 changes its curvature and is exposed to twisting during its up and down movement. This stress is easily absorbed by the spring steel.

The spacer 7 is shown essentially as a circular-cylindrical body in the preferred embodiment of the invention. An advantageous alternative thereto is a body which is prismatic in the center part, which slidingly rests with two of its parallel surfaces on the longitudinal edges 5, 6 of the slot 4, and which is rounded or spherically formed at its two front sides in the slot 4. This alternative embodiment is particularly good for the requirement of keeping the slot 4 open. As a result of the round or rather the spherical ends, the spacer 7 does not catch during movement in the slot 4.

The embodiments of the invention in which an exclusive property or privilege is claimed are defined as follows:

1. In a ski shoe having a hollow shell part and a hollow shaft part, the hollow shaft part having a hollow interior and being movable relative to the shell part into a forward position, the shell part including a hollow raised shell part which extends upwardly from the shell part into the interior of the hollow shaft part, the raised shell having a rearwardly facing first wall section opposing an interior second wall section of the hollow shaft part, the first wall section having an upwardly open slot therein having opposing longitudinal edges which define the width of the slot and are spaced a finite distance from one another, said distance being reduced against the elasticity of the material in response to the movement of the hollow shaft part to the forward position and returning to the distance in response to a movement of the shaft part to a rearward position thereof, and a spacer oriented within the slot and acting against the longitudinal edges which narrow the width of the slot when the shaft part moves toward the forward position thereof, the spacer being arranged movably in the slot, a position of the spacer within the slot being adjustable by an adjusting device, the improvement wherein the adjusting device includes a two arm lever having a first arm and a second arm, at least the first lever arm having a longitudinally extending guide thereon, the two arm lever being pivotally mounted on the raised shell part adjacent the upwardly open slot, the spacer being supported movably on the first arm on the longitudinal guide thereon, the second arm carrying thereon a threaded nut arranged adjustably on an axially stationary and rotatable spindle for effecting a pivotal adjusting movement of the two arm lever and an adjusting of a relative vertical position of the spacer within the upwardly open slot.

2. The ski shoe according to claim 1, wherein the spindle is supported in a mounting which also carries a fulcrum for the two arm lever, the mounting being fastened on the raised shell part of the shoe and oriented laterally adjacent the upwardly open slot at a position constituting half of the height of the upwardly open slot.

3. The ski shoe according to claim 2, wherein the spindle is arranged at a right angle with respect to the upwardly open slot, and has one of a small hand wheel and a tool receiving recess at an end thereof opposite the slot.

4. The ski shoe according to claim 1, wherein the spacer includes a flat disk oriented in the slot and having a diameter corresponding the width of the slot, and wherein the spacer also includes on a side thereof remote from the first arm a small plate larger in diameter than the flat disk and the width of the upwardly open slot, the small plate and the first arm being oriented on opposite sides of the wall section of the raised shell part.

5. The ski shoe according to claim 3, wherein an indicator is provided on the threaded nut for indicating the position of the threaded nut along the spindle, opposite of the indicator being a viewing window in the shaft part of the shoe.

6. The ski shoe according to claim 1, wherein the two arm lever is formed of a spring steel which adapts to the curvature of the raised shell part in a space between the shaft part of the shoe and the raised shell part.

* * * * *